US008313128B2

(12) United States Patent
Belyea et al.

(10) Patent No.: US 8,313,128 B2
(45) Date of Patent: Nov. 20, 2012

(54) SAFETY LOCKING MECHANISM FOR DOORS

(75) Inventors: Vianka Perez Belyea, Boston, MA (US); Tavinder Phull, Newton, MA (US)

(73) Assignee: Rhoost, LLC., Newton, MA (US)

( * ) Notice: Subject to any disclaimer, the term of this patent is extended or adjusted under 35 U.S.C. 154(b) by 454 days.

(21) Appl. No.: 12/544,688

(22) Filed: Aug. 20, 2009

(65) Prior Publication Data

US 2011/0042974 A1 Feb. 24, 2011

(51) Int. Cl.
*E05C 19/18* (2006.01)
*B65D 45/32* (2006.01)

(52) U.S. Cl. . 292/288; 292/258; 292/289; 292/DIG. 65; 70/14

(58) Field of Classification Search ..... 292/348, 292/1, 28, 246, 258, 289, DIG. 15, DIG. 21, 292/DIG. 38, DIG. 60, 288, 307 R, DIG. 65; 70/416, 14–18, 94, 202, 203, 211, 212, 429, 70/430; 24/16 PB, 335, 336
See application file for complete search history.

(56) References Cited

U.S. PATENT DOCUMENTS

| | | | | | |
|---|---|---|---|---|---|
| 2,151,587 | A | * | 3/1939 | Cassileth | 292/288 |
| 2,899,229 | A | | 8/1959 | Jenks | |
| 3,451,708 | A | * | 6/1969 | Brooks | 292/264 |
| D214,736 | S | * | 7/1969 | Anderson | D30/152 |
| 3,542,321 | A | * | 11/1970 | Kahabka | 248/205.3 |
| 3,568,262 | A | * | 3/1971 | Woldman | 24/16 PB |
| 3,855,669 | A | * | 12/1974 | Meyer | 24/16 PB |
| 3,908,233 | A | * | 9/1975 | Caveney et al. | 24/16 PB |
| 4,272,047 | A | * | 6/1981 | Botka | 248/74.3 |
| 4,281,865 | A | * | 8/1981 | Nicholson | 292/258 |
| 4,490,886 | A | * | 1/1985 | Omata | 24/16 PB |
| 4,805,856 | A | * | 2/1989 | Nicoli et al. | 248/74.3 |
| 4,910,831 | A | * | 3/1990 | Bingold | 24/16 PB |
| 5,088,158 | A | * | 2/1992 | Burkholder | 24/16 PB |
| 5,159,728 | A | * | 11/1992 | Bingold | 24/16 PB |
| 5,230,541 | A | | 7/1993 | Nowak | |
| 5,294,160 | A | * | 3/1994 | Arthur | 292/258 |
| 5,398,383 | A | * | 3/1995 | Bingold | 24/16 PB |
| 5,501,493 | A | * | 3/1996 | Arthur | 292/258 |
| 5,709,422 | A | * | 1/1998 | Malone | 292/288 |
| D400,076 | S | | 10/1998 | Jancsek et al. | |
| 5,966,781 | A | * | 10/1999 | Geiger | 24/16 PB |
| 6,018,968 | A | * | 2/2000 | Sides | 70/14 |
| 6,044,669 | A | * | 4/2000 | Levi | 70/18 |
| 6,149,109 | A | * | 11/2000 | Stankowski | 248/74.3 |
| 6,196,033 | B1 | * | 3/2001 | Dowdle | 70/16 |
| 6,240,602 | B1 | * | 6/2001 | Geiger | 24/16 PB |
| 6,364,257 | B1 | * | 4/2002 | Holder | 248/74.3 |
| D471,076 | S | | 3/2003 | Radel | |
| 7,537,250 | B1 | | 5/2009 | Gustafson | |
| 2002/0178766 | A1 | * | 12/2002 | Jackson et al. | 70/18 |

FOREIGN PATENT DOCUMENTS

| | | | |
|---|---|---|---|
| GB | 2088468 | A * | 6/1982 |

* cited by examiner

*Primary Examiner* — Carlos Lugo
*Assistant Examiner* — Alyson M Merlino
(74) *Attorney, Agent, or Firm* — Wilmer Cutler Pickering Hale & Dorr LLP.

(57) ABSTRACT

A door locking device has a central body, locking members, and elongated bands with receiving members extending from the central body. The receiving members can be releasably coupled to the locking members, which are shaped to grasp the receiving members, to secure the apparatus to a door.

13 Claims, 6 Drawing Sheets

SAFETY LOCKING MECHANISM FOR DOORS

BACKGROUND

The present disclosure relates to an apparatus for securing cabinet doors and specifically to a safety lock to limit access by children, the elderly, or pets to cabinets, such as those in kitchens or bathrooms.

SUMMARY

A locking mechanism has a central body with elongated bands extending away from the central body. The bands can be formed into loops and wrapped around a door handle or knob. The bands have mating portions that allow the bands to be releasably coupled to lock the doors from being opened.

Further, a method of locking two or more doors is disclosed. To lock the door, bands that extend from the central body are rotated around or through projections on or near the doors. A receiving member on the band is releasably coupled to a locking member projecting from the central body or band.

The device has a compact arrangement that can be used to releasably lock doors without having rods extending away from the door. Other features and advantages will become apparent from the following detailed description, drawings, and claims.

DETAILED DESCRIPTION

The methods and apparatus described herein relate to the use of an apparatus for securing doors. The device includes bands that wrap around two door projections (knobs) to inhibit access, such as by children.

Figure 1:
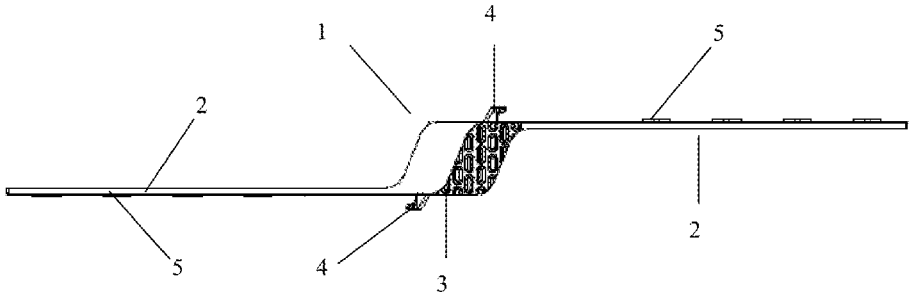
FIG. 1 is an illustration of the locking apparatus in an unlocked position.
Figure 2:
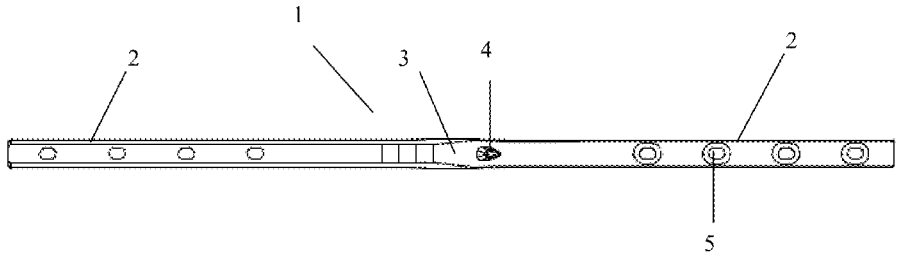
FIG. 2 is an illustration of a top perspective view of the locking apparatus in an unlocked position.
Figure 3:
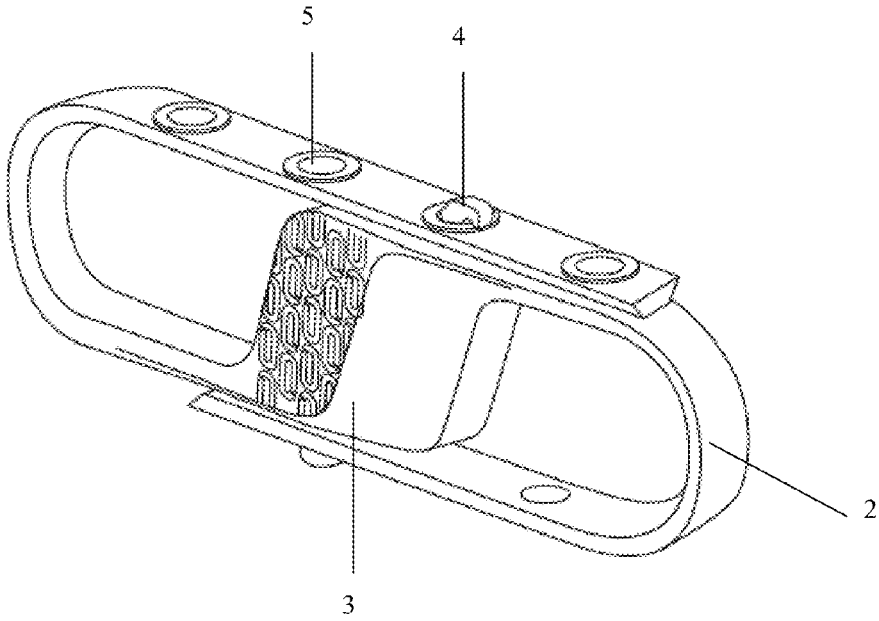
FIG. 3 is a side perspective view of the locking apparatus in a locked position.

Referring to FIGS. 1-3, a locking system 1 has a central body 3 and bands 2 that extend away from the central body 3 in directions that are opposite to each other. Bands 2 have locking members 4 such as tabs or hooks that can extend from the central body 3 or from the bands 2. Elongated bands 2 also have receiving members 5 such as a series of openings on the band. The receiving members 5 can be releasably coupled to the locking members 4 by forming loops and placing them over the tabs, which are sized and shaped to grasp the receiving members 5. For example, the tabs can have a generally curved or angular shape to allow the bands to be secured and then manually released when desired. The bands 2 and locking members 4 are oriented such that the bands 2 extend laterally and wrap around or through a projection on or near a door and return to the locking members 4 to secure the apparatus 1 in place.

The central body 3 has a generally slanted parallelogram shape with slightly rounded corners, and with a portion having a textured surface. The textured portion is primarily for a distinctive appearance.

Figure 4:
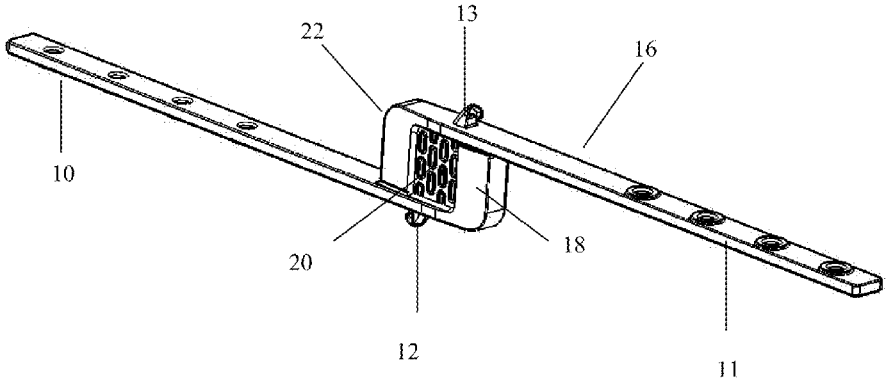
FIG. 4 is an illustration of a perspective view of the locking apparatus in an unlocked position.
Figure 5:
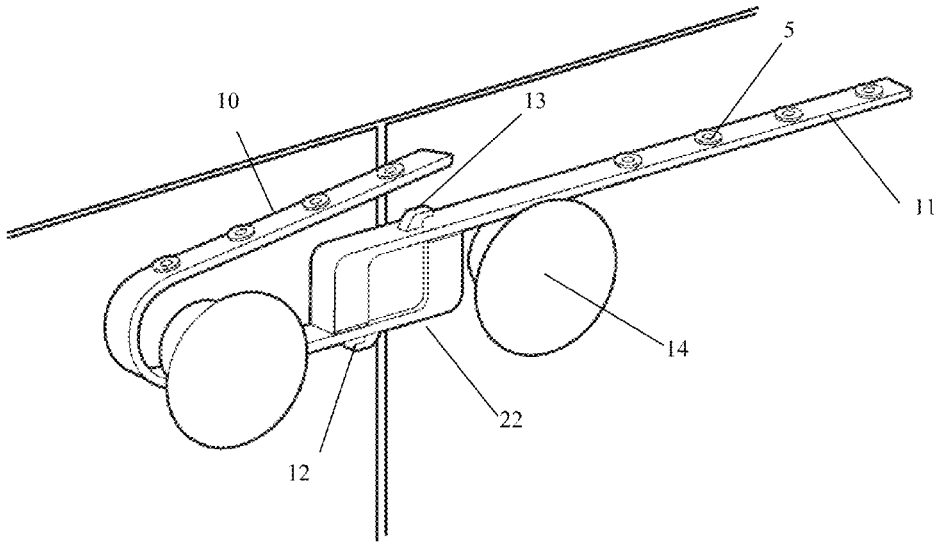
FIG. 5 is a side perspective view of the locking apparatus in an open position mounted on cabinet doors.
Figure 6:
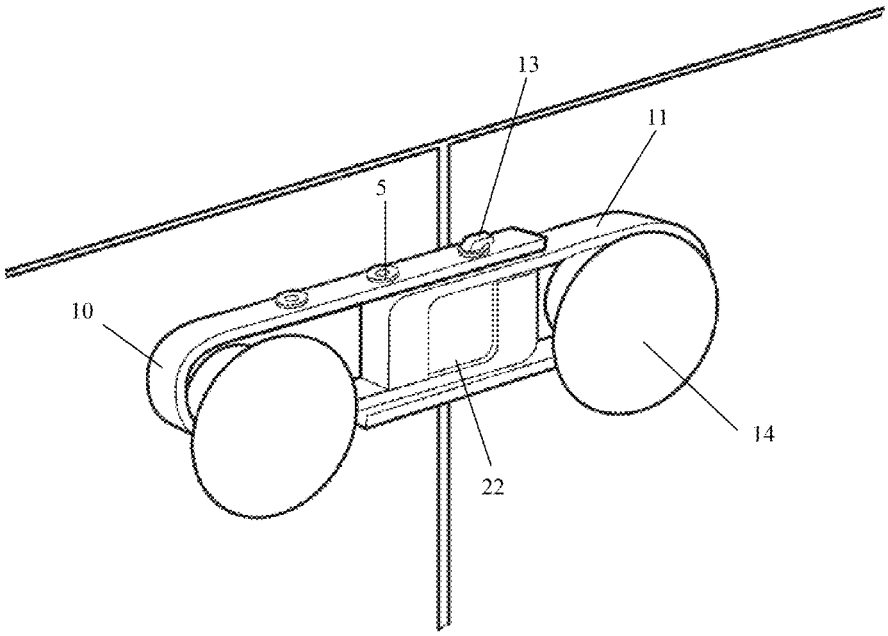
FIG. 6 is a side perspective view of the locking apparatus in a closed position mounted on cabinet doors.

FIGS. 4-6 show another embodiment. While mostly similar to the embodiment of FIGS. 1-3, FIGS. 4-6 show a central body 22 that is generally rectangular with rounded corners. A rectangular peripheral portion 18, which can be made from one or more pieces, surrounds a central rectangular portion 20 that can be recessed and textured. Like the apparatus of FIGS. 1 and 2, apparatus 16 includes two bands, an inferior lateral band 10 and a superior lateral band 11, each extending away from the central body 22 in opposite directions. Further, the apparatus has two locking members, an inferior locking member 12 and superior locking member 13. The locking members 12 and 13 project outwardly and are releasably secured in openings in the bands 10 and 11.

As shown in FIGS. 5 and 6, doors are locked by rotating the superior lateral band 11 around one projection 14 on or near the door, and releasably coupling the inferior locking member 12 to a receiving member 5 on the superior lateral band 11. The opposite side is secured by rotating the inferior lateral band 10 around another door projection 14 and releasably coupling the superior locking member 13 to a receiving member 5 on the inferior lateral band 10. As shown in FIGS. 5 and 6, the locking mechanism is compact around the door knobs, and does not have bands or elongated rods extending away from the knobs.

The doors on which the apparatus 1 and 16 is used can be any type of door from which, or relatively near which, there are at least two projections about which bands can be secured. In one embodiment, the doors are cabinet doors. In another embodiment, they are refrigerator doors.

Further, the apparatus 1 and 16 can be used to secure any number of doors lying along a single plane. To do this, bands are wrapped around the projections 14 from or relatively near the two doors most distal from the center of the apparatus 1 and 16.

There can be a plurality of receiving members 5 on the bands, such as two, three, four, five, or more to allow the size of the loops created by the bands to be made bigger or smaller. This lateral flexibility allows the loops to accommodate different types and sized of handles, which can also be placed at different distances apart in different sets of doors.

While a tab or hook with mating holes are shown, the releasable lock can take one of many different forms, including different forms of tabs and round or elongated openings, indent and detent, a snap fit into an opening, etc. What is generally desirable is for the lock to be generally secure enough to prevent access from children or animals, while allowing the ability to release in a manner that is not very difficult for a typical adult, and capable of being performed manually and without tools.

The bands are made from a substantially flexible but durable material. The bands can be made from an elastomeric material sold under the trademark Santoprene, or a flexible plastic, another elastomer, liquid silicone rubber, or a polymer.

The central body 3 and 13 and locking members 4 are made from rigid and durable materials. In one embodiment, the central body 3 and 22 or locking members 4 are made from Santoprene. In another embodiment, the central body 3 and 22 and/or locking members 4 are made from plastic. In still another embodiment, the central body 3 and 22 and/or locking members 4 are made from metal.

The materials the make up the locking members 4, central body 3 and 22, and the bands can be made from biodegradable and/or recyclable materials.

It is to be understood that while the invention has been described in conjunction with the detailed description thereof, the foregoing description is intended to illustrate and not limit the scope of the inventions, which are defined by the scope of the appended claims. Other aspects, advantages, and modifications are within the scope of the following claims.

What is claimed is:

1. A locking apparatus for securing doors comprising:

a central body having a superior surface and an inferior surface, a first locking member at the superior surface, and a second locking member at the inferior surface;

a first elongated band extending in a first direction away from the superior surface of the central body, the first elongated band comprising one or more first engaging members;

a second elongated band extending in a second direction away from the inferior surface of the central body, the first and second directions being substantially opposite to each other, the second elongated band comprising one or more second engaging members;

wherein the first elongated band and the central body are configured to create a first loop with one of the first engaging members coupling with the second locking member, the first loop having sufficient length to extend around a first door knob, the first elongated band being movable to be releasably connectable to the central body to surround and release the first loop from the first door knob;

wherein the second elongated band and the central body are configured to create a second loop with one of the second engaging members coupling with the first locking member, the second loop having sufficient length to extend around a second door knob, the second elongated band being movable to be releasably connectable to the central body to surround and release the second loop from the second door knob;

wherein, when the first and second loops are positioned around the first and second door knobs, the apparatus is configured to inhibit access through the doors.

2. The apparatus of claim 1, wherein the first and second locking members and the one or more first and second engaging members include one of a plurality of openings or a tab such that, in each case, the tab is on one of the central body and each elongated band, and the plurality of openings are on the other of the central body and each elongated band, the openings allowing the size of the loops to be changed.

3. The apparatus of claim 2, wherein the plurality of openings are on each band to allow the size of the first and second loops to be varied.

4. The apparatus of claim 1, wherein the apparatus is made from one of an elastomer, plastic, or metal.

5. The apparatus of claim 1, wherein the bands are formed monolithically with the central body.

6. The apparatus of claim 1, wherein the apparatus consists essentially of the central body, the bands, and the locking components.

7. A method comprising using the apparatus of claim 1 to lock two doors to prevent them from being opened.

8. The method of claim 7, wherein the first and second locking members and the one or more first and second engaging members each include a tab and a plurality of openings such that, in each case, wherein each tab is on one of the central body and each elongated band, and the openings are on the other of the central body and each elongated band, the method including coupling the bands to the central body with the tabs and openings.

9. The method of claim 7, wherein the one or more first and second engaging members include a plurality of openings on each band to allow the size of the first and second loops to be varied.

10. The apparatus of claim 1, wherein the superior surface of the central body and the first elongated band are coplanar, and the inferior surface and the second elongated band are coplanar.

11. The apparatus of claim 10, wherein the central body is substantially rectangular.

12. The apparatus of claim 1, wherein the superior surface is formed on an upper side of the central body and the inferior surface is formed on a lower side of the central body, the upper and lower sides facing away from each other along a third direction perpendicular to the first and second directions.

13. The apparatus of claim 1, wherein the central body is substantially rectangular.

* * * * *